US006377154B2

(12) United States Patent
Nakamura

(10) Patent No.: US 6,377,154 B2
(45) Date of Patent: Apr. 23, 2002

(54) INTEGRATED IGNITION COIL DEVICE

(75) Inventor: Taku Nakamura, Osaka (JP)

(73) Assignee: Diamond Electric Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/735,805

(22) Filed: Dec. 14, 2000

(30) Foreign Application Priority Data

Dec. 14, 1999 (JP) ..... 11-354013

(51) Int. Cl.[7] ..... H01F 27/02

(52) U.S. Cl. ..... 336/96; 336/192; 336/90; 336/92

(58) Field of Search ..... 336/90, 96, 192, 336/92; 123/634, 635

(56) References Cited

U.S. PATENT DOCUMENTS

| | | | | | |
|---|---|---|---|---|---|
| 3,740,702 | A | * | 6/1973 | Moray | 439/866 |
| 4,295,014 | A | * | 10/1981 | Fox et al. | 200/19 R |
| 6,094,122 | A | * | 7/2000 | Sexton | 336/96 |
| 6,169,471 | B1 | * | 1/2001 | Sakamaki et al. | 336/96 |
| 6,252,482 | B1 | * | 6/2001 | Chiba et al. | 336/96 |

* cited by examiner

*Primary Examiner*—Anh Mai
(74) *Attorney, Agent, or Firm*—McGinn & Gibb, PLLC

(57) ABSTRACT

An angular pin is used in a connecting portion of each component, and a plated copper wire for electrical connection of the component is wound at several turns around the angular pin.

2 Claims, 4 Drawing Sheets

INTEGRATED IGNITION COIL DEVICE

BACKGROUND OF THE INVENTION

The present invention relates to an integrated ignition coil device in which plural ignition coil modules each consisting of a primary coil, a secondary coil, and a core are integrated into one case in order to supply a high voltage to ignition coils respectively disposed in cylinders of a multi-cylinder internal combustion engine.

FIG. 6A is a partially sectional view showing a conventional integrated ignition coil. FIG. 6B is a view showing a state where ignition coil modules are housed in a case and flat terminals are arranged, and FIG. 6C is a view showing a state where the flat terminals are arranged on a cover. FIG. 7 is an enlarged view showing the wiring state in the integrated ignition coil using the flat terminals. In the conventional integrated ignition coil device, each of ignition coil modules 10*a*, 10*b*, and 10*c* is configured by: a primary coil 17 in which a primary copper wire is wound; a secondary coil 19 in which a secondary copper wire is wound; and a core 24 which is made of a ferromagnetic material such as silicon steel plates or the like. The ignition coil modules are housed in a slender case 11 which has a small width and a large length. In order to receive an ignition signal for the ignition coil modules, a primary voltage input portion 15 is attached to the case 11, and a primary voltage input terminal 16 for inputting the primary current is attached to the interior of the primary voltage input portion 15.

Wirings between the primary voltage input terminal 16 of the primary voltage input portion 15 and a primary coil terminal 18 of each primary coil 17, and between a secondary coil terminal 20 of each secondary coil 19 and each of secondary high voltage terminals 21 are configured by flat terminals 22 (formed by brass plates or the like) which are shaped by using press molds.

The integrated ignition coil has a slender shape which is small in width and large in length. Therefore, the wirings between the primary voltage input terminal 16 of the primary voltage input portion 15 and the primary coil terminal 18 of each primary coil 17, and between the secondary coil terminal 20 of each secondary coil 19 and each of the secondary high voltage terminals 21 are as long as 30 cm at the maximum. The wires are connected to respective connecting portions by soldering. The case is closed by a cover 12 and then insulatingly sealed by an epoxy resin or the like. The cover is provided with high voltage towers 23 respectively having the secondary high voltage terminals 21 in order to supply a high voltage to ignition plugs which are not shown.

The primary voltage is applied to the primary voltage input portion 15 which is attached to the ignition coil case 11 to cause the primary coils 17 to generate magnetic fluxes. The core 24 enables the magnetic fluxes to easily pass therethrough. The primary voltage is interrupted in accordance with the ignition timing to generate a high voltage in the corresponding secondary coil 19. The high voltage generated in the secondary coil 19 is supplied to the corresponding ignition plug (not shown) via the secondary high voltage terminal 21 in the corresponding high voltage tower 23 of the cover 12.

In the above-described conventional device, the coupling in the connecting portions of the metal flat terminals and the ignition coil modules is performed by soldering. In a severe environment such as that to which components of an automobile engine are exposed, therefore, deterioration due to thermal stresses for years may cause the soldered portions to be peeled off, or cracks to be produced in edge portions of solders insulatingly sealed by an epoxy resin. This raises a problem in that a trouble which results in disconnection of a wire, or dielectric breakdown may be produced.

The flat terminals 22 through which the metallic terminals are electrically connected to each other are as long as 30 cm at the maximum. Therefore, the production of molds for performing the press molding is expensive, whereby the production cost of the terminals is increased.

SUMMARY OF THE INVENTION

In view of the problems discussed above, it is an object of the invention to provide an integrated ignition coil device in which a trouble due to deterioration with time in metallic terminals and connecting portions of ignition coil modules is eliminated, and terminals can be electrically connected to each other by an economical method.

In order to solve the problems, the provides an integrated ignition coil device comprising: plural ignition coil modules each consisting of a primary coil, a secondary coil, and a core, said ignition coil modules being housed in a case; a primary voltage input portion; and secondary high voltage terminals for respectively supplying a high voltage to ignition coils, wherein wirings to connecting portions of a primary voltage input terminal of said primary voltage input portion, primary coil terminals of said primary coils, secondary coil terminals of said secondary coils, and said secondary high voltage terminals are configured by using a plated copper wire, each of connecting portions is formed into an angular pin-like shape having plural edges in a section, and said plated copper wire is wrap-connected to said angular pin-like connecting portion of each of said terminals so that said plated copper wire is tightly wound at several turns around the connecting portion so as to bite into the edges of the angular pin-like shape.

Preferably, the connecting portions of the primary voltage input terminal, the primary coil terminals, the secondary coil terminals, and the secondary high voltage terminals which portions are formed into an angular pin-like shape may be placed in a state where the connecting portions vertical upstand from the bottom face of the case. According to this configuration, a step of performing wrapping connection can be easily performed on the terminals of an angular pin-like shape.

Also in an integrated ignition coil device in which secondary high voltage terminals for respectively supplying a high voltage to ignition coils are disposed on a cover, the connecting portions of the secondary high voltage terminals and having an angular pin-like shape may be aligned with an axis of winding the plated copper wire so that a step of performing wrapping wiring on the terminals of an angular pin-like shape can be easily performed.

When the above-described means is employed, in the connecting portions of the primary voltage input terminal, the primary coil terminals of the ignition coil modules, and the like, connection can be realized without performing soldering. The plated copper wire is wound at several turns around the connecting portion of each of the terminals and having an angular pin-like shape, by means of wrapping connection, so as to bite into the edges, whereby the terminals having an angular pin-like shape are connected to the plated copper wire. The reliability of the connecting portions is not lowered even by thermal stresses for years. Since wiring terminals for electrically connecting metallic terminals are not used, no molds are required.

DETAILED DESCRIPTION OF THE PREFERRED EMBODIMENTS

An embodiment of the invention will be described with reference to FIGS. 1 to 5.

Figure 1:
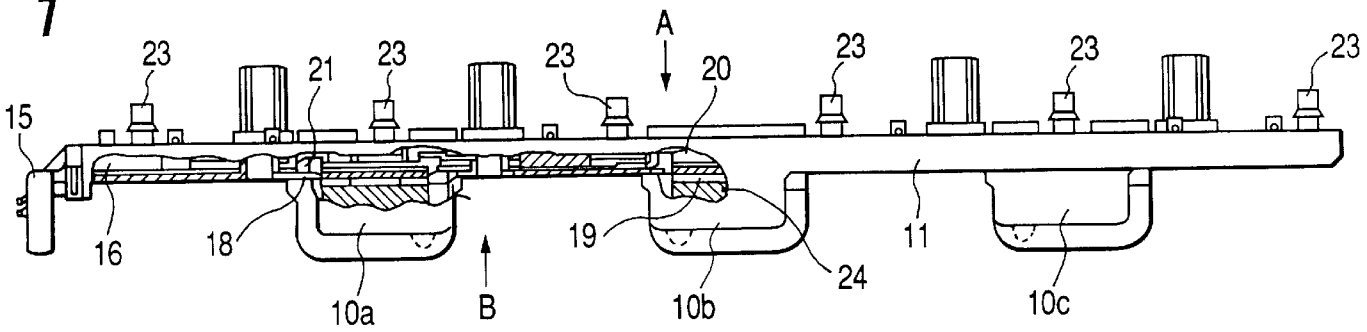
FIG. 1 is a partially sectional front view showing an embodiment to which the technique of the invention is applied.
Figure 2:
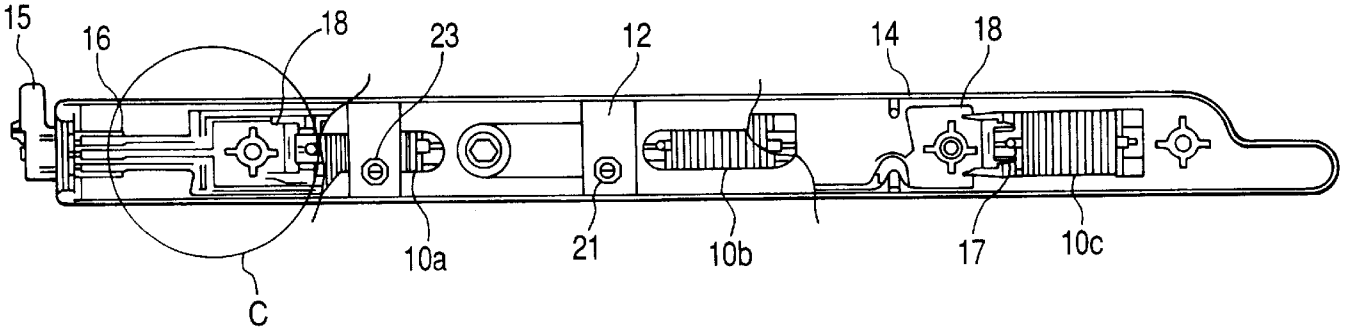
FIG. 2 is a partially sectional view showing the embodiment to which the technique of the invention is applied, as seeing from the point A in FIG. 1.
Figure 3:
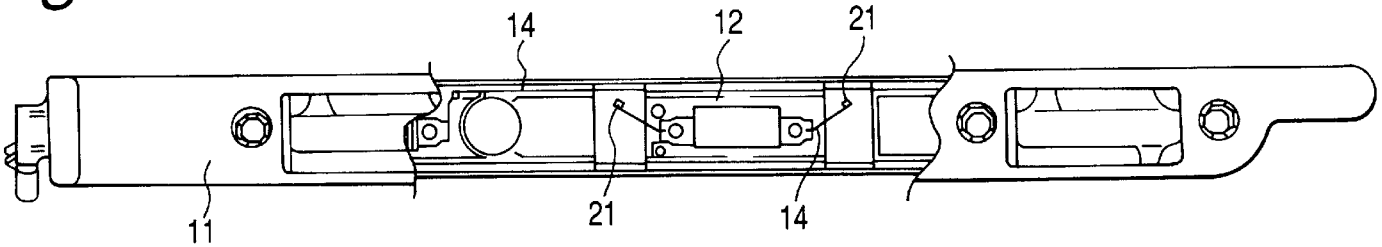
FIG. 3 is a partially sectional view showing the embodiment to which the technique of the invention is applied, as seeing from the point B in FIG. 1.

FIG. 1 is a partially sectional front view showing an embodiment to which the technique of the invention is applied, and FIG. 2 is a partially sectional view showing the embodiment to which the technique of the invention is applied, as seeing from the point A in FIG. 1. FIG. 3 is a partially sectional view showing the embodiment to which the technique of the invention is applied, as seeing from the point B in FIG. 1, FIG. 4 is an enlarged view of the portion C of FIG. 3 and showing the embodiment to which the technique of the invention is applied, and FIG. 5 is a view showing wrapping connection in the embodiment to which the technique of the invention is applied.

In the integrated ignition coil device shown FIGS. 1 to 3, each of ignition coil modules 10*a*, 10*b*, and 10*c* is configured by: a primary coil 17 in which a primary copper wire is wound; a secondary coil 19 in which a secondary copper wire is wound; and a core 24 which is made of a ferromagnetic material such as silicon steel plates or the like. The ignition coil modules are housed in a case 11. In order to receive an ignition signal for the ignition coil modules, a primary voltage input portion 15 is attached to the case 11, and a primary voltage input terminal 16 for inputting the primary current is attached to the interior of the primary voltage input portion 15. Connecting portions of the primary voltage input terminal 16, primary coil terminals 18, and secondary coil terminals 20 are previously formed into an angular pin-like shape having plural edges.

Figure 4:
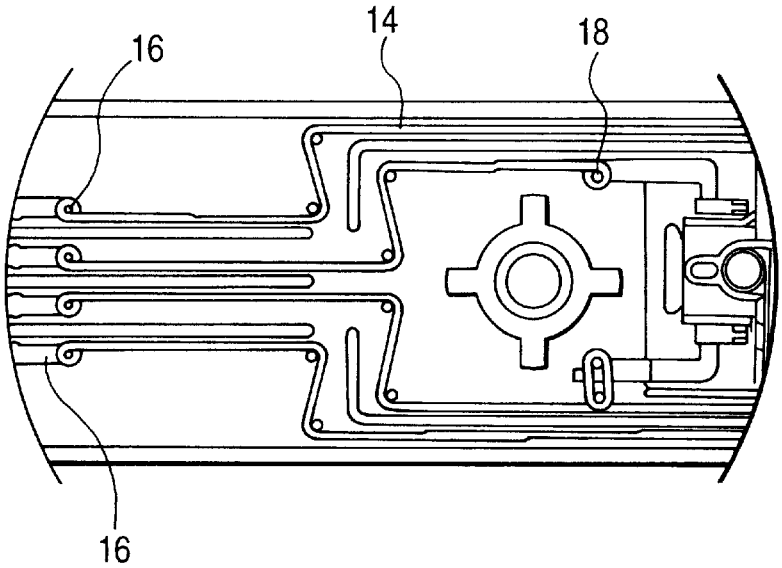
FIG. 4 is an enlarged view of the portion C of FIG. 3 and showing the embodiment to which the technique of the invention is applied.

Preferably, referring to FIG. 4, in order to facilitate wrapping connection on a terminal 13 having an angular pin-like shape, the terminal is placed in a state where the terminal vertical upstands from the bottom face of the case 11. The connections from the primary voltage input terminal 16 to the primary coil terminals 18 of the ignition coil modules, and those from the secondary coil terminals 20 of the secondary coils 19 to secondary high voltage terminals 21 are performed by wirings of plated copper wires 14. Each of the connecting portions is realized by wrapping connection in which the plated copper wire 14 is wound at several turns around the terminal 13 having an angular pin-like shape.

Figure 5:
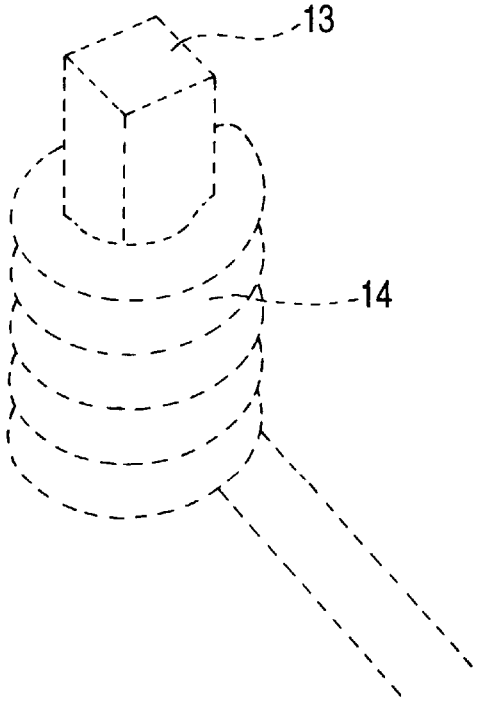
FIG. 5 is a view showing wrapping connection in the embodiment to which the technique of the invention is applied.
Figure 6A:
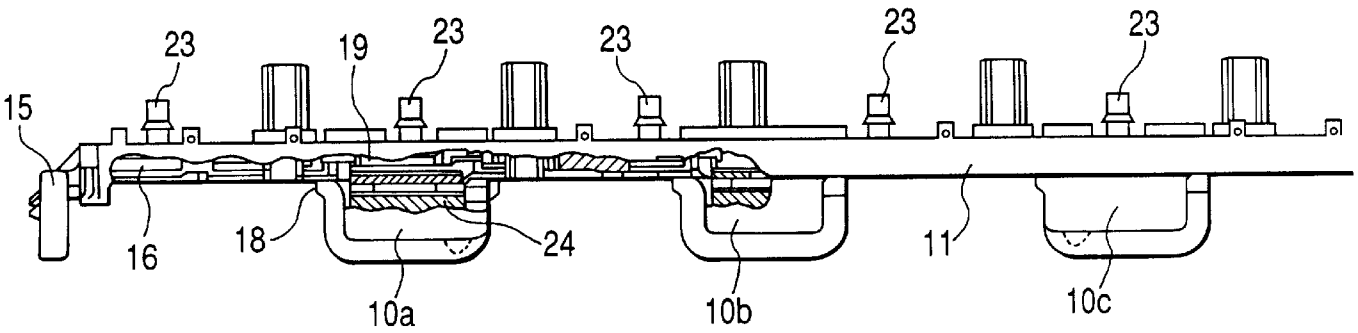
FIGS. 6A to 6C are partially sectional views showing a conventional integrated ignition coil.
Figure 6B:
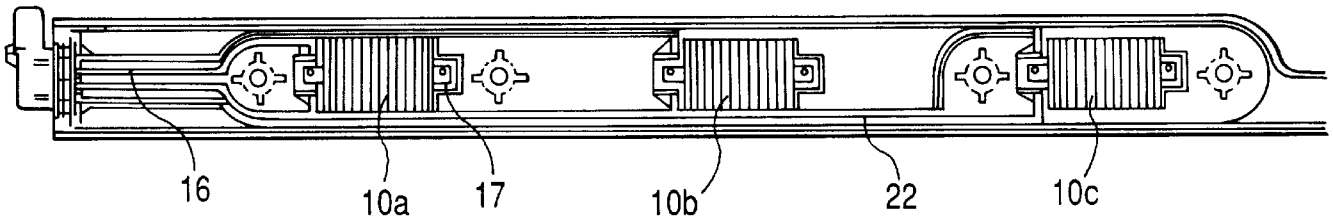
Figure 6C:
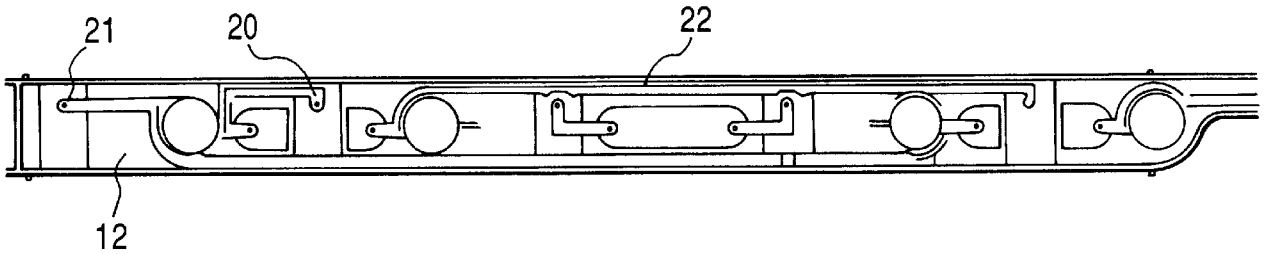
Figure 7:
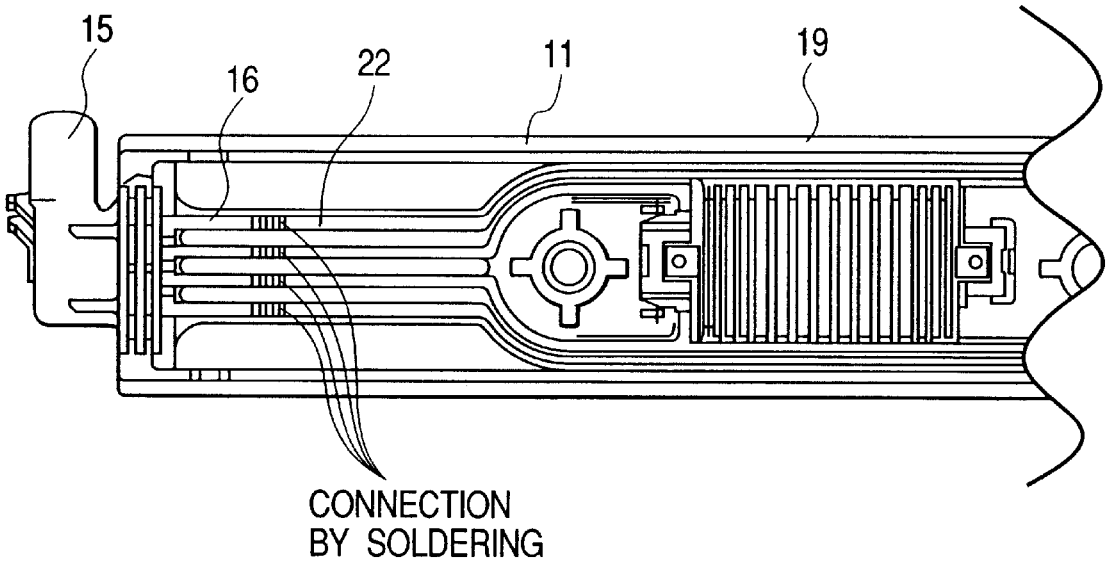
FIG. 7 is an enlarged view showing a state where wiring is performed on an integrated ignition coil with using conventional flat terminals.

FIG. 5 is a view showing the wrapping connection. In FIG. 5, the plated copper wire 14 is wound at five turns around the terminal 13 having an angular pin-like shape, so as to bite into the edges of the angular pin-like shape, whereby the angular pin and the plated copper wire 14 are integrally connected to each other. The connected connecting portions are realized without using soldering, to be formed as connections which can withstand thermal stresses for years. In this case, a winding of about five turns as shown in FIG. 5 is sufficient for satisfactorily connecting the plated copper wire 14 with the terminal 13 having an angular pin-like shape.

The integrated ignition coil device shown in FIG. 1 comprises high voltage towers 23 each of which supplies a high voltage generated in the secondary coil 19 of the corresponding ignition coil module, to an ignition coil (not shown). The integrated ignition coil device is closed by a cover 12 having the secondary high voltage terminals 21 in the high voltage towers, and then insulatingly sealed by an epoxy resin or the like.

According to the invention, each connecting portion is realized by wrapping connection so that a plated copper wire bites a terminal having an angular pin-like shape, whereby the terminal having an angular pin-like shape and the copper wire are integrally connected to each other. Therefore, soldering is not required in the connecting portions of the ignition coil modules, or those through which the primary voltage input terminal and the primary coil terminals of the primary coils, and the secondary coil terminals of the secondary coils and the secondary high voltage terminal are electrically connected to each other, and the reliability against deterioration with time is improved. Furthermore, flat terminals which are used in the conventional art for electrically connecting the primary voltage input terminal with the primary coils, and the secondary coils with the secondary high voltage terminal can be eliminated, and hence the production cost can be lowered.

What is claimed is:

1. An integrated ignition coil device comprising:

ignition coils respectively disposed in cylinders of a multi-cylinder internal combustion engine;

plural ignition coil modules for respectively supplying a high voltage for ignition to said ignition coils, each of said ignition coil modules including a primary coil, a secondary coil, and a core, said ignition coil modules being housed in a case;

a primary voltage input portion; and secondary high voltage terminals for respectively supplying a high voltage to said ignition coils, wherein a primary voltage input terminal of said primary voltage input portion and a connecting portion of a primary coil terminal of each of said primary coils are connected to each other by a plated copper wire, each of said terminals has a connecting portion which is formed into an angular pin-like shape having plural edges in a section, and said plated copper wire is subjected to wrapping connection in which said plated copper wire is wound at several turns around said angular pin-like connecting portion of each of said terminals.

2. An integrated ignition coil device comprising:

ignition coils respectively disposed in cylinders of a multi-cylinder internal combustion engine;

plural ignition coil modules for respectively supplying a high voltage for ignition to said ignition coils, each of said ignition coil modules consisting of a primary coil, a secondary coil, and a core, said ignition coil modules being housed in a case;

a primary voltage input portion; and secondary high voltage terminals for respectively supplying a high voltage to said ignition coils, wherein a secondary coil terminal of each of said secondary coils and a connecting portion of each of said secondary high voltage terminals are connected to each other by a plated copper wire, each of said terminals has a connecting portion which is formed into an angular pin-like shape having plural edges in a section, and said plated copper wire is subjected to wrapping connection in which said plated copper wire is wound at several turns around said angular pin-like connecting portion of each of said terminals.

* * * * *